US009909844B2

(12) United States Patent
Alter et al.

(10) Patent No.: US 9,909,844 B2
(45) Date of Patent: Mar. 6, 2018

(54) STRUCTURAL COMPONENT FOR ARMORED VEHICLES

(75) Inventors: Rolf-Mathias Alter, Echternach (LU); Jürgen Walter, Rodgau (DE)

(73) Assignee: EC Technik GmbH, Bitburg (DE)

( * ) Notice: Subject to any disclaimer, the term of this patent is extended or adjusted under 35 U.S.C. 154(b) by 0 days.

(21) Appl. No.: 14/344,987

(22) PCT Filed: Sep. 10, 2012

(86) PCT No.: PCT/EP2012/067660
§ 371 (c)(1),
(2), (4) Date: Mar. 14, 2014

(87) PCT Pub. No.: WO2013/037738
PCT Pub. Date: Mar. 21, 2013

(65) Prior Publication Data

US 2014/0338521 A1 Nov. 20, 2014

(30) Foreign Application Priority Data

Sep. 15, 2011 (DE) ..... 10 2011 113 520

(51) Int. Cl.
*F41H 7/04* (2006.01)
*F41H 5/013* (2006.01)
(Continued)

(52) U.S. Cl.
CPC ..... *F41H 7/04* (2013.01); *F41H 5/013* (2013.01); *F41H 5/023* (2013.01); *F41H 5/04* (2013.01); *F41H 5/0464* (2013.01); *F41H 7/044* (2013.01)

(58) Field of Classification Search
CPC ... F41H 5/00; F41H 5/013; F41H 5/02; F41H 5/04; F41H 5/0414; F41H 5/0428; F41H 5/0471; F41H 5/0478
(Continued)

(56) References Cited

U.S. PATENT DOCUMENTS 4,078,350 A * 3/1978 Ting ..... 52/475.1
4,566,237 A * 1/1986 Turner ..... 52/269
(Continued)

FOREIGN PATENT DOCUMENTS

CA 2119210 A1 9/1995
DE 8804278 U1 6/1988
(Continued)

OTHER PUBLICATIONS

Int'l Preliminary Report on Patentability dated Mar. 27, 2014 in Int'l Application No. PCT/EP2012/067660.
(Continued)

*Primary Examiner* — Benjamin P Lee
(74) *Attorney, Agent, or Firm* — Panitch Schwarze Belisario & Nadel LLP

(57) ABSTRACT

Armor plating is provided for armored land vehicles or watercraft, the armor having a base armor plate and an additional armor plate fixed thereto on the enemy side, such that it can be removed. A structural component can be used as a base armor plate for such vehicles, and comprises a layered structure with a core composite having an inner honeycomb core and at least one covering layer. The layered structure does not contain supporting metal layers or ceramic, hard material layers. Another essential characteristic is the use of fixture elements which are anchored in the core composite to allow additional armor plating to be detachably fixed on the enemy side. The core composite therefore essentially offers basic protection itself, while also acting as the carrier structure for interchangeable additional armor plating.

15 Claims, 2 Drawing Sheets

(51) Int. Cl.
*F41H 5/02* (2006.01)
*F41H 5/04* (2006.01)

(58) Field of Classification Search
USPC ..... 89/36.01, 36.02, 36.04, 36.07, 36.08
See application file for complete search history.

(56) References Cited

U.S. PATENT DOCUMENTS

| | | | | |
|---|---|---|---|---|
| H000129 | H * | 9/1986 | Hansen | 89/36.04 |
| 4,981,735 | A * | 1/1991 | Rickson | 428/36.9 |
| 5,093,957 | A * | 3/1992 | Do | 16/2.1 |
| 5,340,633 | A * | 8/1994 | van der Loo et al. | 428/114 |
| 5,542,777 | A * | 8/1996 | Johnson | 403/389 |
| 6,082,240 | A * | 7/2000 | Middione et al. | 89/36.08 |
| 6,807,890 | B1 * | 10/2004 | Fuqua | 89/36.02 |
| 6,920,817 | B2 * | 7/2005 | Ravid et al. | 89/36.11 |
| 7,159,503 | B1 * | 1/2007 | Weatherwax | 89/36.04 |
| 7,601,654 | B2 | 10/2009 | Bhatnagar et al. | |
| 7,685,921 | B2 * | 3/2010 | Dagher et al. | 89/36.02 |
| 7,694,621 | B1 * | 4/2010 | Ma | F41H 5/0492 89/36.02 |
| 7,762,175 | B1 * | 7/2010 | Bhatnagar et al. | 89/36.02 |
| 7,980,165 | B2 * | 7/2011 | Misencik et al. | 89/36.02 |
| 8,276,497 | B2 * | 10/2012 | Hunn | 89/36.02 |
| 8,393,601 | B2 * | 3/2013 | de Mola | 267/141.5 |
| 8,596,018 | B2 * | 12/2013 | Dagher et al. | 52/704 |
| 8,640,428 | B2 * | 2/2014 | Naik et al. | 52/787.1 |
| 8,741,416 | B2 * | 6/2014 | Juergens | 428/117 |
| 8,757,042 | B2 * | 6/2014 | Pfister | 89/36.07 |
| 8,777,193 | B2 * | 7/2014 | Loret de Mola | 267/141.5 |
| 8,863,634 | B1 * | 10/2014 | Lou | 89/36.02 |
| 2004/0020354 | A1 * | 2/2004 | Ravid et al. | 89/36.02 |
| 2006/0048640 | A1 * | 3/2006 | Terry et al. | 89/36.02 |
| 2006/0137294 | A1 * | 6/2006 | Waits, Jr. et al. | 52/787.1 |
| 2007/0180982 | A1 * | 8/2007 | Dagher et al. | 89/36.02 |
| 2007/0234895 | A1 * | 10/2007 | Singh et al. | 89/36.07 |
| 2009/0090236 | A1 * | 4/2009 | Misencik et al. | 89/36.02 |
| 2010/0297388 | A1 * | 11/2010 | Dagher et al. | 428/116 |
| 2011/0041679 | A1 * | 2/2011 | Pollock et al. | 89/36.11 |
| 2011/0079136 | A1 | 4/2011 | Bettencourt et al. | |
| 2011/0183104 | A1 * | 7/2011 | Juergens | 428/116 |
| 2012/0137865 | A1 * | 6/2012 | Citterio et al. | 89/36.02 |
| 2012/0174747 | A1 * | 7/2012 | Hummel et al. | 89/36.02 |
| 2012/0180633 | A1 * | 7/2012 | Dagher et al. | 89/36.04 |
| 2013/0043344 | A1 * | 2/2013 | Ruonavaara et al. | 244/118.1 |
| 2013/0098232 | A1 * | 4/2013 | Locke et al. | 89/36.02 |
| 2013/0340601 | A1 * | 12/2013 | Townsend et al. | 89/36.02 |
| 2014/0318358 | A1 * | 10/2014 | Reichert | 89/36.02 |
| 2015/0096479 | A1 * | 4/2015 | McCarthy et al. | 109/1 S |
| 2015/0143986 | A1 * | 5/2015 | Tunis et al. | 89/36.02 |

FOREIGN PATENT DOCUMENTS

| | | | | |
|---|---|---|---|---|
| DE | 202005000198 | U1 | 5/2006 | |
| DE | 102005022868 | A1 | 11/2006 | |
| EP | 1361408 | A1 | 11/2003 | |
| WO | 2007024243 | A2 | 3/2007 | |
| WO | 2009061539 | A2 | 5/2009 | |
| WO | WO 2010033266 | A2 * | 3/2010 | F41H 5/04 |

OTHER PUBLICATIONS

Int'l Search Report dated Dec. 7, 2012 in Int'l Application No. PCT/EP2012/067660.
Search Report dated Jul. 9, 2012 in DE Application No. 10 2011 113 520.4.
Office Action dated Jun. 22, 2016 in CA Appl. No. 2,845,786.

* cited by examiner

STRUCTURAL COMPONENT FOR ARMORED VEHICLES

CROSS-REFERENCE TO RELATED APPLICATIONS

This application is a Section 371 of International Application No. PCT/EP2012/067660, filed Sep. 10, 2012, which was published in the German language on Mar. 21, 2013, under International Publication No. WO 2013/037738 A1 and the disclosure of which is incorporated herein by reference.

BACKGROUND OF THE INVENTION

Technical Field

The invention generally concerns the armoring of vehicles, in particular military land vehicles or water craft. The invention specifically concerns structural components for such a vehicle or craft, which have a layer structure with an inner honeycomb core and at least one cover layer.

State of the Art

Monolithic armor steel plates as structural elements in armored land vehicles or water craft, for example in tanks, have long been known. An armor steel plate of typically 8 mm thick armor steel is of a weight in relation to surface area of between 60 kg/m$^2$ and 70 kg/m$^2$. Accordingly conventional armoring results in a very high overall weight. A high armoring weight is evidently detrimental inter alia in regard to mobility, payload and also the range of the vehicle.

Armors of a modular structure, which typically include a monolithic steel plate of a thickness of 8 mm as a base armor plate and a variable additional armor plate which is geared to the respective mission, for example comprising ceramic composite tiles, are in the meantime also state of the art. In this case also the armor steel plate affords a base protection and ensures structural integrity. The variable additional armor plate (abbreviated in English as: "add-on") makes it possible to increase the protection of the base armor plate, being adapted to the mission involved, and to adapt it for example to given effectors. Modular armors are nowadays preferred by virtue of polyvalent threats in the area of operation. However, the add-on protection of modular armors leads to an additional increase in weight of the overall system. Often vehicles or craft which are in the theater of operations are already close to or at the limit of the admissible overall mass. It will be noted however that a further advantage of modular armors is that the vehicle can be transported, divided into two freight assemblies, in particular by air, that is to say the add-on armor can be loaded and transported separately.

Accordingly there is a wish to achieve marked reductions in weight, in particular also in relation to modular protective structures.

In protective structures from areas of use of a different general kind, which do not concern protection for or armoring of vehicles or craft, it is already known to use composite or compound materials. Thus, for example, International patent application Publication No. WO 2010/033266 describes a composite panel for protection from shock waves, which is suitable for airplane construction. That composite material is intended to be suitable in particular for example for constructing baggage storage facilities within an aircraft and there to reduce the threat due to explosion, for example of a bomb smuggled on board. A further composite panel with a protective action is known from U.S. Pat. No. 7,685,921. That panel is suitable for constructing temporary quarters or storage facilities, so-called SEAHUTS. U.S. Pat. No. 5,554,816 in turn describes various portable devices for personnel protection, in which a composite panel is also used. Finally U.S. Pat. No. 3,577,836 describes protective clothing, for example a protective jacket, with a layer structure of composite materials.

The use of composite materials in a layer structure is however also already known in the field of vehicle or craft structure or armored vehicles or crafts.

International patent application publication No. WO 03/058151, for example, describes a mine protection for armored vehicles, which has a layer structure with a plurality of different honeycomb cores. That structure is complex and within the proposed layer structure also includes inter alia thin metal plates and layers of ceramic material. A good protective action is indeed to be expected from such a structural component, but with an only slight saving in weight.

European Patent Application Publication No. 0 237 095 describes a composite plate of a similar layer structure, which also has a plurality of thin metal plates and layer of ceramic material. That layer structure is intended to afford a high protective action with at the same time a limited weight in relation to surface area.

A further complex layer structure for armoring vehicles is know from U.S. Pat. No. 4,404,889. That is intended to achieve an increased protective effect, but the weight in relation to surface area is comparatively high (see Table A from U.S. Pat. No. 4,404,889) as in this case also steel plates are used within the layer structure. A further composite armor is also known from U.S. Pat. No. 4,529,640. The last-mentioned armor includes a steel plate at the enemy side, to which a honeycomb core is applied as a spacer for a layer, at the friend side, comprising glass fiber layer portions.

German Utility Model No. 88 04 278 describes an armor plate for motor vehicles, which has three layers, namely an inner layer of fiber composite plastic (FCP), an intermediate layer of ceramic material and a layer of honeycomb material, that is opposite to the vehicle plate.

European Patent Application Publication No. 1 679 484 discloses a device for fixing ballistic protective elements to objects to be protected from the effect of weapons, in particular to housings of armored vehicles.

European Patent No. 1 361 408 discloses a composite armor structure for ballistic protection of a gap between at least one armor module and the structural components of the basic structure of the vehicle or aircraft to be protected. The body of that grid-like structure has an upper, a lower and an intermediate layer with a hollow space in which a ceramic material is provided. In accordance with European Patent No. 1 361 408 the structure is fitted in addition to the structural component or components and the additional armoring, that is to say the armor modules, and it thus increases the overall weight.

French Patent Application No, 2723191 in contrast describes a layer structure which is comparatively simple in comparison with the above-mentioned examples and which manages without a layer of armor steel and which is intended to achieve an additional saving in weight. That layer structure has a core composite including a honeycomb core with cover layers on both sides, comprising fiber composite plastic (FCP). At the enemy side, glued to the core composite are ceramic tiles which are protected from external aggressions by an additional fiber-reinforced plastic layer.

The structural components described hereinbefore comprising composite material are either in the form of an actual additional armor or, when in the form of a base armor plate, they are provided with complex protective functions. None of them at all can be directly employed for a use which is preferred in recent times, as modular armor with variable additional protection.

BRIEF SUMMARY OF THE INVENTION

Object of the Invention

An object of the present invention is thus to provide a structural component for armored vehicles or craft which is particularly light and which in a simple fashion permits the use of interchangeable additional armoring as well as affording basic protection.

General Description

That object is already attained by a structural component for armored vehicles including a layer structure which has a core composite with an inner honeycomb core and with at least one cover layer, wherein in the layer structure there is neither a supporting metal layer nor a hard material layer of ceramic, and anchored in the core composite are fixing elements for releasably fixing an additional armor plating which is to be mounted at the enemy side, so that substantially the core composite itself affords basic protection, and the core composite represents the supporting structure for interchangeable additional armor plating.

The structural component according to the invention is distinguished in that in the layer structure there is neither a supporting or monolithic metal layer, for example of armor steel, nor a hard material layer of ceramic. The layer structure primarily comprises a core composite of composite material with a honeycomb core, preferably of fiber composite plastic (FCP), and with a cover layer on the honeycomb core, at least on one side and preferably on both sides. Just that simplified lightweight structure already reduces the weight. In addition a structural component according to the invention is distinguished in that anchored in the core composite are fixing elements serving for releasably fixing an additional armor plating which is to be mounted at the enemy side or at the threat side. In that way in a simple manner the use of the layer structure is made possible as a pure basic protection or basic armoring, to which modular additional armoring can be fitted variably, depending on the respective use.

According to the invention therefore essentially the core composite itself already affords basic protection, in particular from shock waves or pressure waves ("blast") and possibly together with a fragmentation protection (so-called "spall liner") also against fragmentation splinters. In addition according to the invention the core composite itself (per se) forms the actual supporting structure for an interchangeable additional armor plating which is to be selected so as to be adapted to the mission involved, for example in the form of modules. The structural component is accordingly not only self-supporting but the core composite is suitable for carrying the load of current additional armor platings and transmitting same to the remaining structure of the vehicle or craft. No additional armor plating is permanently integrated into the layer structure. The proposed solution makes it possible to optimize the protection of the vehicle or craft, governed by the use involved, in particular with the aim of weight minimization.

Tests revealed a surprisingly low degree of dynamic buckling in comparison with armor steel as the base armor plating of comparable weight in relation to surface area. High weight-related compression strength is basically a crucial advantage of a core composite with a honeycomb core. However it was surprisingly found by tests that core composites according to the invention exhibit a highly advantageous, vibration-dependent variation in respect of their basic properties. Particularly in regard to upsetting and elongation rates corresponding to typical explosion compression waves, a considerable increase in the modulus of elasticity on the one hand and also the compression and tension strength on the other hand were ascertained, in comparison with the static load situation. That at least proportionally explains the surprisingly good protective action in relation to "blast", that is to say in respect of shock waves.

Consequently it is proposed according to the invention that, in contrast to conventional approaches, the tried-and-tested armor steel is to be completely substituted, as the basic protection, by a layer structure of composite material, in particular a fiber composite with a honeycomb core. On the other hand the invention proposes, also contrary to conventional solutions, that protection from different effectors is not directly integrated into the layer structure. That means a significant reduction in the mass of the basic protection and the overall mass of the vehicle or craft.

In a preferred embodiment the mean weight in relation to surface area of the core composite in itself, in particular the proportion of the layer structure which substitutes the typical steel plate (that is to say without having regard to a fragmentation protection at the friend side) is less than 40 kg/m$^2$, still more preferably less than 15 kg/m$^2$, in spite of a wall thickness which is necessarily greater in comparison with armor steel and which is preferably overall less than 50 mm. Compared to armor steel as the basic protection, weight savings of far above 10%, on the basis of an estimation up to 50%, are to be expected by virtue of the proposed layer structure. It will be appreciated that weight savings of over 50% in comparison with armor steel as the basic protection are also an aim to attain and are conceivable.

Desirably the core composite considered in itself comprises a honeycomb core and mounted at both sides thereof in opposite relationship cover layers. Such a core composite together with a fragmentation protection layer ("spall liner") which is at the friend side, that is to say towards the vehicle interior, can represent the basic protection of the vehicle.

In a preferred embodiment the structural component comprises a layer structure with substantially, that is to say apart in particular from adhesive layers and functional films without a protective action, only the following four layers: a cover layer at the enemy side, a honeycomb core, a cover layer at the friend side and a fragmentation protection layer at the friend side. Optionally for connecting the layers there can be provided interposed functional layers like adhesive layers or interface layers, the thickness of which however is negligible. Such functional layers only serve for making the connection or forming the composite or acting as an interface between different materials, for example the fragmentation protection and the cover layer at the friend side. Thermoplastic materials have proven to be particularly suitable adhesives for connecting the layers. Preferably the cover layers are made from fiber composite, in particular glass fiber-reinforced plastic (GRP). The honeycomb core in contrast can be made from different materials, besides FCP, in particular with glass fibers or aramide fibers, also for example from aluminum film. Fragmentation protection is preferably afforded by a high-strength plastic, in particular high-strength polyethylene (PE) like for example Dyneema®. Other tear-resistant plastics, for example an FCP with aramide fibers, can also be used as fragmentation protection.

The layer for fragmentation protection can be of a wall thickness which is similar to the core composite or possibly even greater. Overall the wall thickness of the structural component will naturally be greater than in the case of an armor steel affording corresponding protection.

Good results were achieved if the honeycomb core is of a mean wall thickness of below 50 mm, preferably in the region of between 5 mm and 50 mm. That permits comparatively thin components with at the same time adequate structural integrity. Adequate basic production can be achieved with cover layers at the friend side and/or at the enemy side, with a mean wall thickness in the region that is already between 0.2 mm and 15 mm, preferably in the region of between 0.3 mm and 10 mm.

Metal bushes can be used as desirable and inexpensive fixing elements for the interchangeable additional armor plating. They can preferably be provided in a locally delimited fixing region within the honeycomb core and let into the core composite and anchored in the fixing region, for example by adhesive. A desirable fixing region can be produced in per se known manner by suitable filling material, preferably comprising a thermoset. Preferably the bushes used are flange bushes of metal, for example hard steel, with a female thread. Upon being anchored in the core composite the corresponding flange bears against the cover layer, at the enemy side, of the core composite so that the flange is supported there and accordingly, together with the fixing region which already has a load-distributing effect, also optimizes the support for an addition armor plating on the structural component, that is to say in the mechanical sense the reaction to impact forces (impact force action). Preferably but not necessarily, the individual fixing regions are provided distributed in accordance with a regular pattern of the structural component, that is to say which is uniformly distributed in relation to the surface thereof, for providing uniform load distribution.

To connect the structural component to the remaining structure of the vehicle or craft, for example a frame structure of armor steel, a plurality of locally delimited reinforced regions can desirably be provided in the outer edge region of the core composite, in part or over the entire periphery. Suitable potting material can desirably be provided here, into which for example bores are introduced to join the structural component to the remaining structure of the vehicle. Similarly it is also possible for example for additional components to be integrated into the structural component, like for example armored glass panels. For weight optimization purposes the potting material, as also for the fixing elements of the additional armor plating, is preferably provided in separate, locally isolated regions. It is also possible to provide a boundary which extends over the entire periphery of the core composite with potting material, which desirably has inwardly directed spurs which are reinforced in region-wise manner, for example of a peninsular-shaped configuration in front view. Those spur portions can then be used as a reinforced region for fixing purpose.

A structural component in accordance with the foregoing description is suitable in particular as a constituent part of the base armor plating of an armored vehicle. According to the invention the additional armor plating can be releasably fixed to a suitable structural component, preferably with an interposed air gap between the additional armor plating and the base armor plating.

The invention correspondingly also includes the use of a proposed structural component in an armored land vehicle or water craft, in particular for military purposes. In particular the use of a structural component according to the invention is considered as a door in an armored vehicle.

In a desirable configuration the honeycomb core is designed in typical fashion with hollow cells in a honeycomb form and is preferably produced using an expansion process.

Particularly but not exclusively in relation to a structural component to be used as a door it is desirable to provide a lower portion and an upper portion which are angled relative to each other and joined by a flexing region. In that respect a preferred configuration is one in which the honeycomb core passes in the flexing region seamlessly from the lower portion to the upper portion.

Particularly in the case of a greatly angled configuration of a continuous honeycomb it is desirable to use honeycomb which is over-expanded completely or only in the region of the angling. Such an over-expanded honeycomb is referred herein as honeycomb with a honeycomb form.

BRIEF DESCRIPTION OF THE SEVERAL VIEWS OF THE DRAWINGS

The invention is described in greater detail hereinafter, without limitation on the scope of protection, by the description of a preferred embodiment with reference to the accompanying drawings in which.

Figure 1:
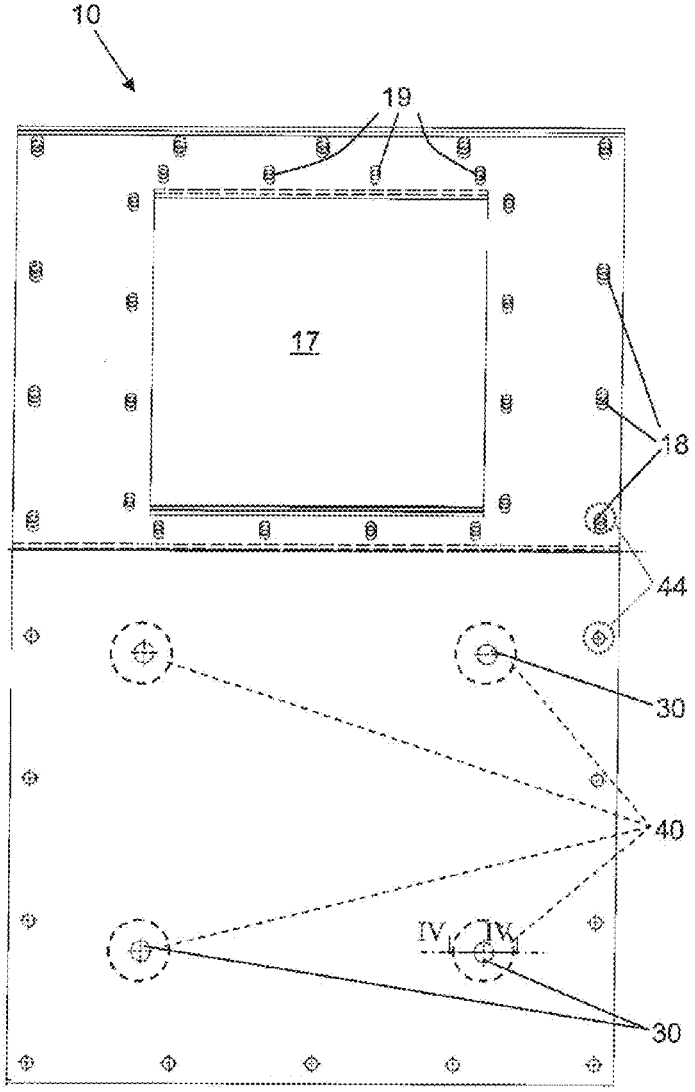
FIG. 1 shows a front view of a structural component designed according to an embodiment of the invention for use as a door of an armored vehicle or craft.
Figure 2:
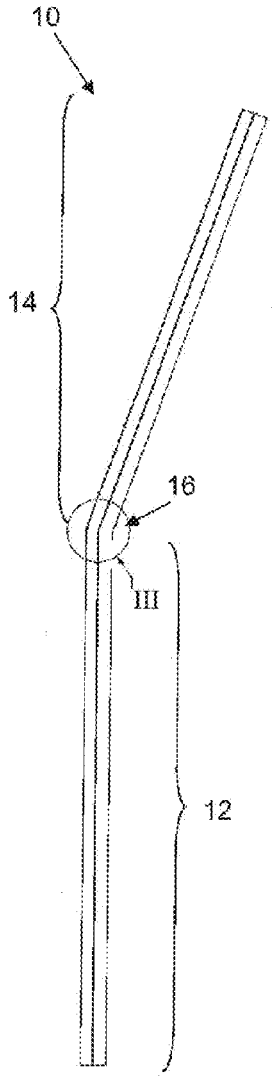
FIG. 2 shows a longitudinal section vertically through the structural component of FIG. 1.

Identical references denote identical components in all Figures.

DETAILED DESCRIPTION OF THE INVENTION

In FIGS. 1 through 4 a structural component designed for use as a door is generally identified by 10. The structural component 10 is intended for use in an armored land vehicle, for example a military armored personnel carrier, an armored infantry fighting vehicle, an armored reconnaissance vehicle, or a combat tank.

By way of introduction it is to be noted that FIGS. 1 through 4 do not show the per se known construction of suitable additional armor platings. Such an additional armor plating ("add-on") is, however, always mounted at the enemy side on the structural component 10 in the operationally readiness condition of the vehicle, for most effectors or projectiles are nowadays capable of penetrating common basic protection, including for example the structural component 10. Therefore generally modules which are adapted to the respective mission of an additional armor plating are mechanically removably fixed in the form of so-called "add-on protection" to a structural component 10 according to the invention in order to increase the protection level and in particular to minimize the risk of penetration of different effectors.

Such additional armor platings which are not shown in greater detail produce the main contribution to the desired multi-hit capacity, for resistance against "improvised explosive devices" (IEDs) and so-called "explosive formed projectile IEDs" (EFP-IEDs) which are increasingly occurring. A decisive basic protection function at least in relation to shock waves and fragmentation splinters is however also achieved by the structure (described hereinafter) of a structural component 10 as shown in FIGS. 1 through 4.

Governed by the use involved, the structural component 10 is first of a contour with a flat structure, that is suitable for the intended use, here as a door. The structural component 10 shown in FIGS. 1 through 4 is of a two-part construction with an upper portion 12 and a lower portion 14 which are angled from each other by a flexing region 16, with a suitable angle for example of about 10-30o. The angling configuration by virtue of the flexing region 16 reduces the probability of a highly detrimental perpendicular strike of effectors as at least a partial region of the structural component 10, for example the upper portion 12, can be disposed inclined relative to the vertical after being fitted to the vehicle. An opening 17 can be provided, for example for an armored glass window, in the upper portion 12. For fixing the structural component 10 to a frame of the vehicle, there are provided bores 18 distributed over the periphery, through the structural component 10. The opening 17 is equally bordered by regularly distributed bores 19 for fixing of the armored glass panel.

Figure 3:
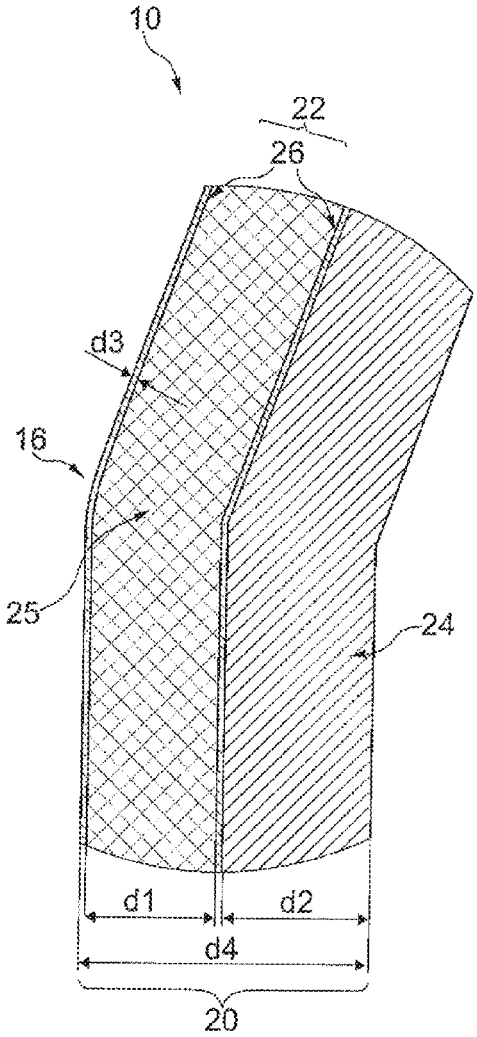
FIG. 3 shows an enlarged portion of the longitudinal section in FIG. 2 corresponding to region III.
Figure 4:
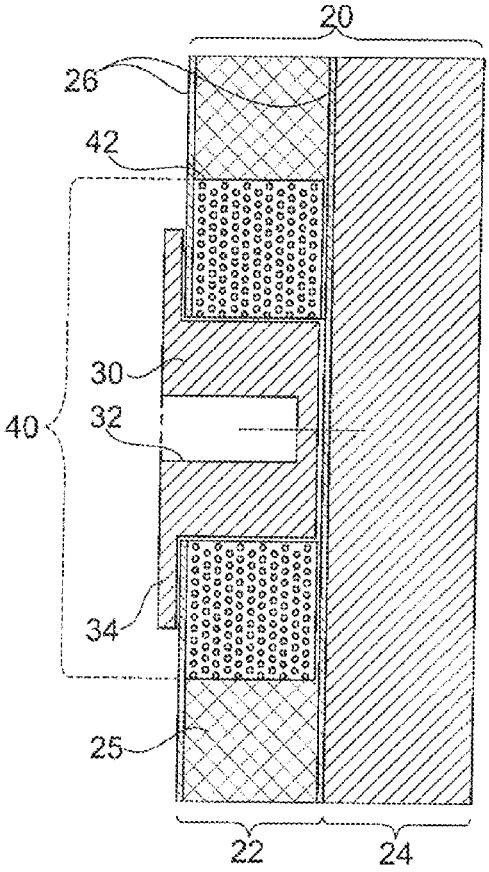
FIG. 4 shows an enlarged partial section along line IV-IV in FIG. 1.

As can best be seen from FIGS. 3-4, the structural component 10 is of a comparatively simple layer structure 20. The layer structure 20 is only made from two substantial constituent parts, namely a core composite 22 and a fragmentation protection layer 24 at the rear or friend side. The fragmentation protection layer 24 is made for example from a continuous plate-like layer of monolithic high-strength PE of per se known kind, for example Dyneema® from Koninklijke DSM N.V., Heerlen, Netherlands. Other materials suitable as the fragmentation protection can also be used, for example Kevlar® (from DuPont, Wilmington, USA). The fragmentation protection layer 24 is materially bonded as shown in FIGS. 1-4 by adhesive to the inwardly disposed cover layer 26 of the core composite 24, but it could also be fixed in another fashion, for example by riveting.

The core composite 22 which is essential to the invention in turn substantially only comprises three layers, namely the honeycomb core 25 which extensive in terms of surface area and cover layers 26 on both sides thereof. In this case the honeycomb core 25 is of a known structure with hollow cells in hexagonal cross-sectional form or honeycomb form. The honeycomb core 25 is produced in per se known manner for example using an expansion process. The cell walls in the honeycomb core 25 are directed in the core composite 22 perpendicularly to its areal direction of extension, that is to say horizontally in FIG. 4. Suitable processes for the production of composite panels or the core composite 22 are known to the man skilled in the art.

Both the honeycomb core 25 and also the cover layers 26 are preferably each made from FCP, wherein different material combinations are considered. Highly modular fiber materials like for example glass fiber honeycomb, KEVLAR®, NOMEX® or other aramide fibers, carbon fibers, or also metal or mineral fibers which impregnated with suitable synthetic resin are hardened to give a highly modular FCP can be recommended for production of the honeycomb core 25. Unimpregnated honeycomb cores 25 of metal film, in particular aluminum film, are also basically suitable. The thickness or wall thickness d1 of the honeycomb core 25 depends in particular on the weight of the add-on protection to be fitted, wherein d1 should be in the region of between 0.5 cm and 5 cm.

Single-layer or multi-layer composite materials or also monolithic layers can be used in the core composite 22 as cover layers 26 of the honeycomb core 25. In particular lightweight materials like GRP, CRP, aluminum film or also monolithic aramides or other polymers like high-strength PE are considered. The thickness or wall thickness of the cover layers 26, denoted by d3 in FIG. 3, can typically be between 0.3 mm and 10 mm depending on the respectively required weight of the basic protection structure, and do not have to be identical on both sides. Besides the load-carrying capacity of the core composite 24, further basic protection functionalities, for example including in relation to fragmentation splinters, can also be adjusted by way of the material and thickness of the cover layers 26. The cover layers 26 are materially bonded to the honeycomb core 25 by adhesive. The adhesive adopted is an adhesive join which is suitable in accordance with the material pairings of cover layers 26 and honeycomb core 25. In the case of cover layers 26 and honeycomb core 25 of GRP a good adhesive bond can be effected by hardening a thin intermediate layer (not shown) of a suitable thermoplastic material. Finally, in regard to production of the core composite 22, it is also to be noted that the angle between the lower portion 12 and the upper portion 14, that is to say the curvature in the flexing region 16, is preferably already implemented by plastic deformation and without cutting machining prior to hardening of the FCP cover layers 26 and the adhesive join thereof to the honeycomb core 25. Accordingly in the flexing region 16 in the preferred configuration the honeycomb core 25 is seamlessly continuous or is formed in one piece without a join, in particular without an assembly of two separate honeycomb portions.

In FIG. 3 reference d2 also denotes the wall thickness of the fragmentation protection layer 24. That wall thickness d2 in contrast depends substantially purely on the function of the fragmentation protection layer 24 and should preferably be in the region of between 1 cm and 5 cm. Tests (see below) have shown that in particular high-strength polyethylene (PE) is capable of coherently defending against an EFD-IED, that is to say with buckling but without cracking or tearing of the fragmentation protection layer 24. The necessary thickness of a fragmentation protection layer 24 can however vary according to the respective application.

A plurality of fixing elements 30 are provided in the structural component 10 on the enemy side for removably fixing an additional armor plating linked to use involved. As shown in FIG. 1, in the case of symmetrical components, the fixing elements 30 are desirably distributed approximately equally and symmetrically over the area. That achieves a more uniform load distribution, both in regard to weight of the additional armor plating and also and in particular in regard to strike impact forces. To simplify the view, FIG. 1 does not show any fixing elements in the upper portion 14, but they can also be provided there. Preferably, one fixing element 30 is provided approximately per 0.2 $m^2$-0.5 $m^2$.

The structure and function of the fixing elements 30 can be seen in greater detail from FIG. 4. Each fixing element is in the form of a flange bush 30, for example of suitable steel or light metal. The fixing elements 30 can alternatively be made from high-strength plastic. In the illustrated example the flange bush 30 has a female thread 32 into which a suitable pin (not shown) is screwed, as a further part of the fixing elements. An additional armor plating is in turn releasably fixed to that pin, wherein the pin is used as a spacer for producing an air gap between the structural component 10 and the additional armor plating. An air gap is typically used, inter alia as that renders certain effectors substantially ineffective against the armor. It will be noted however that the additional armor plating can also be removably screwed on by means of the flange bushes 30 in such a way as to bear directly against the structural component 10. To increase the load-bearing capability the flange bushes 30 have at their end a flange 34 which is integrally formed thereon. The flange 34 bears in a disc shape against the surface at the enemy side, of the outer cover layer 26. The flange socket 30 is additionally supported by the flange 34 to achieve improved force transmission to the core composite 22 which is optimized in respect of pressure loading.

As can further be seen from FIG. 4, a respective locally delimited fixing region 40 is also provided for the transmission of force from the fixing element 30 into the core composite 22. To produce the fixing regions 40 a filling material 42 is already introduced into the cells of the honeycomb core 25 prior to production of the core composite 22. The filling material 42 is introduced in such a way that all cells within the respectively desired surface regions are completely filled up. A hardenable thermoset is particularly preferably used as the filling material 42. It is however also possible to use metal, plastic or fiber composite filling materials or other filling material 42 which is usually employed for so-called "potting." It is only after the filling material 42 is introduced that the cover layers 26 are applied so that the cover layers, like also the honeycomb core, are bondingly connected to the filling material 42. That provides overall for a high resistance force against pressure and tension in each fixing region 40, such force still exceeding that of the rest of the surface of the core composite 22. To minimize weight the smallest possible amount of filling material 42 overall should be used.

The hardened filling material 42 is then bored to produce a blind hole which projects to just before the inner cover layer 26, that is to say at the friend side. Then, as shown in FIG. 4, a respective flange bush 30 is anchored in each fixing region 40 as a fixing element, in the blind hole of the finished core composite 22. Anchoring is effected by suitable adhesive involving bonding between the materials, depending on the pairs of materials respectively used for the filling material 42 and the flange bush 30, in the blind hole of the core composite 22. Flange bushes 30 can however also be anchored in bores passing through the core composite 22. The fragmentation protection layer 24 is at any event not adversely affected by the flange bush 30 or its bore. That provides that the fixing element in the form of the flange bush 30 is also secured in relation to tensile force generated by the weight of the additional armor plating. Also, at least one reinforced region (44), or a plurality of reinforced regions (44) as shown in FIG. 1, are distributed over at least part of or an entire periphery of the outer edge region of the core composite (22) for connecting the structural component (10) to a remaining structure of the vehicle.

Finally, key data relating to specific prototypes and test results achieved therewith are set forth below:

Example 1 (Structure Enemy Side→Friend Side)

| | | |
|---|---|---|
| Weight in relation to area: | about 35.5 kg/m$^2$ (without spall liner 24) | |
| Total wall thickness: | d4: 50 mm (+/− 1 mm) | |
| | Thickness: | Material: |
| Cover layer (26) | d3: 10 mm | GRP solid laminate |
| Honeycomb core (25) | d1: 10 mm | high-module FCP(*) |
| Cover layer (26) | d3: 10 mm | GRP solid laminate |
| Spall liner (24) | d2: 20 mm | PE solid material (Dyneema ®) |

(*)from Euro-Composites S.A., Echternach, Luxembourg

Test Results for Example 1:

In a blast impact test initially without additional armor plating dynamic buckling was measured with TNT with steel collars in direct comparison with armor steel of an 8 mm wall thickness. The maximum value (peak) of the dynamic buckling was surprisingly only ⅔ in the result, that is to say 66% of the dynamic buckling of the comparative test sample of armor steel.

In a further test, to simulate an additional armor plating (add-on) a ceramic plate of about 5 cm wall thickness and while retaining about a 10 cm air gap was fixed to the fixing elements 30 of a structural element 10 as shown in FIGS. 1 through 4, with the dimensioning of Example 1. That structure was bombarded from a distance with an EFP-IED. Protection from ballistic action was admittedly achieved primarily by the additional armor plating, but that was pierced by the EFP-IED projectile. The projectile was contained with buckling but without cracking or tearing in the integrated fragmentation protection layer 24 (spall liner) of the layer structure 20.

Example 2 (Structure Enemy Side→Friend Side)

| | | |
|---|---|---|
| Weight in relation to area: | about 6.71 kg/m$^2$ (without spall liner 24) | |
| Total wall thickness: | d4: 40 mm (+/− 1 mm) | |
| | Thickness: | Material: |
| Cover layer (26) | d3: 0.9 mm | GRP solid laminate |
| Honeycomb core (25) | d1: 18.2 mm | high-module FCP(*) |
| Cover layer (26) | d3: 0.9 mm | GRP solid laminate |
| Spall liner (24) | d2: 20 mm | PE solid material (Dyneema ®) |

(*)from Euro-Composites S.A., Echternach, Luxembourg

Test Results for Example 2:

This prototype of Example 2, which in spite of the same total thickness d4 is still lighter, was subjected to a stricter blast impact test with spherical TNT charge in the MIEDAS Test Installation (Meppen Improvised Explosive Device Assessment Structure). To simulate a less impact-resistant additional armor plating an armor steel plate which was only 3 mm in thickness was screwed without an air gap directly on to the structural component 10, with the dimensions of Example 2.

In spite of the wall thickness of the cover layers 26, that is reduced by more than an order of magnitude, and the markedly increased explosive force, buckling without cracking could also be achieved in that test.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A structural component for an armored vehicle, the component comprising:

an additional armor plating providing ballistic protection, the additional armor plating being removably fixed at an enemy side and exerting a load on the structural component;

a layer structure having a core composite including an inner honeycomb core and at least one cover layer, the layer structure including neither a supporting metal layer nor a ballistic impact layer of ceramic;

at least three fixing regions, each fixing region comprising a corresponding respective locally delimited surface area that comprises a blind hole and that is located within the honeycomb core of the core composite, each fixing region containing at least one fixing element that is at least partially inserted into the blind hole and that cooperates with the additional armor plating for releasable fixing of the additional armor plating on the enemy side each fixing element having a form of a flange bush comprising a flange bearing against the at least one cover layer at the enemy side, such that substantially the core composite itself affords basic protection and the core composite represents a supporting structure for interchangeable additional armor plating; and at least one reinforced region for connecting the structural component to a remaining structure of the armored vehicle, wherein all cells of the honeycomb core within the respective locally delimited surface area of each of the at least three fixing regions are completely filled with a filling material such that, in each of the at least three fixing regions, the fixing element is anchored in the respective blind hole and to the filling material surrounding the respective blind hole.

2. The structural component as set forth in claim 1, wherein a mean weight in relation to a surface area of the core composite is less than 40 $kg/m^2$, optionally less than 15 $kg/m^2$.

3. The structural component as set forth in claim 1, wherein the core composite comprises the honeycomb core and two mutually opposite cover layers and together with a fragmentation protection layer at a friendly side represents the basic protection.

4. The structural component as set forth in claim 3, wherein the structural component comprising the layer structure comprising the following layers:

one of the two mutually opposite cover layers at the enemy side;

the honeycomb core, optionally of fiber-reinforced plastic;

another one of the two mutually opposite cover layers at the friendly side;

the fragmentation protection layer at the friendly side, optionally high-strength polyethylene, which is fixed directly on the cover layer at the friendly side, and optionally adhesive layers between the layers.

5. The structural component as set forth in claim 1, wherein the honeycomb core has a mean wall thickness (d1) in a range of between 3 mm and 75 mm, optionally in a range of between 5 mm and 50 mm.

6. The structural component as set forth in claim 5, wherein the cover layer at a friendly side and/or the cover layer at the enemy side has a mean wall thickness (d3) in a range of between 0.2 mm and 15 mm, optionally in a range of between 0.3 mm and 10 mm.

7. The structural component as set forth in claim 1, wherein the fixing elements include fixing bushes which are respectively anchored in the at least three fixing regions within the honeycomb core of the core composite by an adhesive.

8. The structural component as set forth in claim 1, further comprising a plurality of reinforced regions distributed over at least part of or an entire periphery of the outer edge region of the core composite for connecting the structural component to the remaining structure of the vehicle.

9. The structural component as set forth in claim 1, wherein the honeycomb core has hollow cells in honeycomb form, optionally produced using an expansion process.

10. The structural component as set forth in claim 1, having a form of a door.

11. The structural component as set forth in claim 10, wherein a lower portion and upper portion of the door are angled relative to each other and are connected by a flexing region.

12. The structural component as set forth in claim 11, wherein the flexing region of the honeycomb core runs seamlessly from the lower portion to the upper portion.

13. Armor of an armored vehicle, the armor comprising a base armor plating and an additional armor plating is removably fixed thereto at an enemy side, optionally with an air gap, wherein the base armor plating has at least one structural component as set forth in claim 1.

14. An armored military land vehicle or water craft having a door in a form of a structural component as set forth in claim 1.

15. The structural component as set forth in claim 1, wherein the filling material is a hardenable thermoset.

* * * * *